US005375447A

United States Patent [19]

Del Fabro et al.

[11] Patent Number: 5,375,447

[45] Date of Patent: Dec. 27, 1994

[54] METHOD TO CARRY OUT BENDS AND RELATIVE DEVICE

[75] Inventors: Giorgio Del Fabro, Cassacco-Fraz.Montegnacco; Marcello Del Fabro, Udine, both of Italy

[73] Assignee: M.E.P. Macchine Elettroniche Piegatrici SpA, Reana Del Rojale, Italy

[21] Appl. No.: 120,556

[22] Filed: Sep. 14, 1993

[30] Foreign Application Priority Data

Sep. 15, 1992 [IT] Italy ..... UD92A000140
Jun. 16, 1993 [IT] Italy ..... UD93A000110

[51] Int. Cl.[5] ..... B21D 7/022; B21D 7/16

[52] U.S. Cl. ..... 72/307; 72/217; 72/7; 72/37

[58] Field of Search ..... 72/307, 217–219, 72/388, 428, 149, 7, 37

[56] References Cited

U.S. PATENT DOCUMENTS

| | | | |
|---|---|---|---|
| 4,350,033 | 9/1982 | Ishihara | 72/149 |
| 4,681,210 | 7/1987 | Miki | 72/307 |
| 4,989,429 | 2/1991 | Del Fabro et al. | 72/307 |
| 4,996,866 | 3/1991 | Masera et al. | 72/387 |
| 5,199,292 | 4/1993 | Del Fabro et al. | 72/307 |
| 5,228,322 | 7/1993 | Del Fabro et al. | 72/307 |

FOREIGN PATENT DOCUMENTS

| | | | |
|---|---|---|---|
| 0032656 | 7/1981 | European Pat. Off. . | |
| 349953 | 7/1989 | European Pat. Off. . | |
| 0502341 | 2/1992 | European Pat. Off. . | |
| 2472523 | 7/1980 | France . | |
| 2553314 | 9/1984 | France . | |
| 3830 | 1/1987 | Japan | 72/307 |
| 9002005 | 8/1988 | WIPO . | |

OTHER PUBLICATIONS

Patent Abstracts of Japan, vol. 9, No. 22, Jan. 1985; & JP-A-59-169-629 (Hitachi) Sep. 1984–Abstract.

*Primary Examiner*—Daniel C. Crane
*Attorney, Agent, or Firm*—Antonelli, Terry, Stout & Kraus

[57] ABSTRACT

Method to carry out bends of a bundle (13) of bars having a diameter up to 32 mm. or more, the bars (13) being superimposed one on another in a plane substantially normal to the work platform, the bending machine (10) comprising; a bending unit (14) including an abutment roll (17) and a bending pin (16), retaining and clamping units (18) positioned as counterparts to each other in relation to the plane of positioning of the centerline of the bundle (13) of bars, the retaining and clamping units (18) being able to move vertically on inclined lateral guides (26), and a unit (11) including a gripper (12) for the controlled lengthwise displacement of the bundle (13) of bars, the retaining and clamping mechanism (18) being partly downwardly retracted during the steps of displacement of the bundle (13) of bars so as to provide a partial opening which enables the bundle (13) of bars to slide and be guided, the gripper (12) of the unit (11) performing the controlled lengthwise displacement of the bars being opened partly in at least one step of the bending cycle so as to keep the bundle (13) of bars superimposed one on another in a substantially vertical position.

15 Claims, 3 Drawing Sheets

METHOD TO CARRY OUT BENDS AND RELATIVE DEVICE

BACKGROUND OF THE INVENTION

This invention concerns a method to carry out bends and the relative device.

This invention is applied correctly to the field of the simultaneous processing of a plurality of bars for building work, whether those bars are obtained as sheared lengths or from coiled rolls, and advantageously to the processing of round, ribbed or shaped bars having a nominal diameter up to 32 mm.

The invention is applied advantageously, but not only, to bending machines having a horizontal platform of the type disclosed in EP-A-0.501.212 in the name of the same applicants.

The bending machines to which this invention is applied are normally employed to bend in four directions bundles of bars superimposed vertically, one bar on another, so as to produce geometric shapes which can be used in building work as reinforcement stirrups for reinforced concrete.

Such bending machines are disclosed, as regards their substantial components, in EP-A-0.501.212 and may have, or not have, an upstream store for bars.

These machines comprise a bending unit which may be of a rocking type (see EP-A-0.379.029) or of an orientable type (see EP-A-0.386.457) or of another type suitable for the purpose.

Means to retain and clamp a bundle of bars superimposed vertically are included advantageously together with the bending unit, as taught in EP-A-0.501.212, and are located immediately upstream and immediately downstream of the bending unit.

One or more lifting arms may cooperate with the bending unit, as in EP-A-0.502.341.

The retaining and clamping means act as abutment elements during the bending step and also as means to align and clamp the bundle of bars in position.

The retaining and clamping means of the state of the art have a first working position, in which they protrude from the work platform to clamp the bundle of bars to be bent, and a second retracted position in which they are located below the work platform so as not to contact the bundle of bars during the step of displacing and positioning the bundle.

A drawing unit cooperates with the bending unit, as is disclosed in EP-A-0.501.212. This drawing unit may also consist of rolls or tracked means located upstream and/or downstream of the bending unit so as to obtain a controlled lengthwise displacement of the bundle of bars.

Various problems which have to be overcome are entailed with this type of machine. A first problem is linked to the dimensional inaccuracies that distinguish the bars leaving the rolling step. These inaccuracies may vary even along the length of one and the same bar and are distinguished by a geometric shape different from the nominal shape; for instance, more or less oval shapes are often to be found on round bars.

Another problem consists in the lengthwise tensions which build up in the bar during the rolling, coiling and uncoiling steps; the straightening step is not always able to fix these tensions in a stable manner.

The tensions, if they are not fixed in the bar during the straightening step, are released in the bending step, so that the geometric figure produced becomes positioned on different planes at an angle to each other.

The final outcome of this is the production of reinforcement stirrups having a geometric conformation which is not level and therefore not suitable for use.

Another important problem is connected to the need to keep the bars of the bundle vertically superimposed on each other so that they can be engaged, clamped, guided and positioned correctly.

The falling of one or more bars prevents the retaining and clamping means from clamping the bars in the correct superimposed positions, from holding them correctly positioned in an identical manner and therefore from obtaining the same figures with the bars forming the same bundle.

Attempts are made at the present time to overcome this problem by guiding the sliding bundle of bars laterally by means of the bending unit itself by placing the bars in contact with the suitably positioned bending pin and abutment roll so as to define a passage having a width substantially almost the same as the diameter of the bars being displaced lengthwise.

This solution entails a great lengthening of the times of the cycle owing to the required positioning or repositioning of the bending unit for each bend. Moreover, this system is not always able to overcome the problem since the bars which have fallen do not always rise into position again, and moreover it is not always possible to adopt this contrivance.

These problems linked to the high speed of bending and displacing the bundle of bars do not allow identical stirrups for reinforced concrete to be produced from bars in the same bundle.

Furthermore, it often happens that bundles of bars on which processing has started have to be discarded because the bars become entangled with each other.

Besides, stirrups which are not level or not correct may be found in one and the same bundle of stirrups.

FR-A-2.472.523 discloses a bending machine which includes means to butt and displace the bars lengthwise; these means consist of a thrust block, which is thrust against the rear end of the bars so as to make the front end of the bars cooperate with a resilient thrust abutment stop able to move lengthwise. So as to ensure lateral guiding, the bars are held in a U-shaped guide, which is open at its upper side and positioned upstream of the bending unit.

This bending machine entails a plurality of drawbacks including incorrect butting of the bars, inasmuch as the length of the bars is not always constant and is subject to the tolerances used in shearing the bars to size.

Moreover, the bending machine disclosed in this document requires replacement of the U-shaped guide whenever the diameter of the bars being processed is changed, so as to ensure correct vertical alignment of the bundle of bars. Furthermore, the inclusion of bars not having a constant diameter makes the solution of this document unacceptable for modern rates of output.

Besides, in the machine of this document of the state of the art the bundle of bars in the bending step is not clamped at its end opposite to the end at which the bend is made, and this situation may lead to bends which are not the same in bars of the same bundle.

Moreover, the bending machine of this document enables bends to be made only downstream of the bending unit and only in one direction, whether clockwise or anti-clockwise, and thus restricts considerably the number of figures which can be produced.

Furthermore, the machine of this document includes containing means which have the purpose of preventing the bundle of bars from being lifted from the work platform. The containing means disclosed are of a static type and consist of two stationary plates fitted to the thrust block and abutment stop respectively. These plates are installed in a stationary manner at a pre-set distance from the work platform and therefore have to be replaced from time to time to be suitable for the height of the bundle of bars being processed.

Besides, these plates have only one working position and therefore are always in contact or substantially in contact with the highest bar of the bundle of bars, and the plate associated with the abutment stop creates friction during the bending step.

Moreover, the thrust block and the plate associated with the thrust block have to have dimensions such that they can cooperate with the bars held in the U-shaped guide and therefore have to be replaced when the diameter of the bars being processed is changed.

SUMMARY OF THE INVENTION

The present applicants have designed, tested and embodied this invention to overcome the shortcomings of the state of the art and to achieve further advantages.

The purpose of the invention is to provide a device to bend a bundle of bars superimposed on each other vertically so as to produce from the bars of one and the same bundle identical level stirrups for reinforcement of reinforced concrete.

The device according to the invention is able to ensure the forming of a bundle of substantially level and correctly bent stirrups simultaneously.

The invention arranges to apply to the bending machines disclosed in EP-A-0.501.212 a pressure unit generally having the form of a plate or a flat plate supported and moved by suitable supporting means.

One or more lifting arms, as disclosed in EP-A-0.502.341, may cooperate with the bending unit of the bending machines disclosed in EP-A-0.501.212.

This pressure unit is made to act as a contrast element to press against the bundle of bars at the bent segment of the bundle of bars, that is to say, during the successive steps of bending the bundle of bars.

According to a first lay-out the pressure unit acts in the zone of the bending unit and keeps the bars pressed at the zone of the bend being formed.

According to another lay-out the pressure unit acts downstream, or also downstream, of the bending unit and advantageously and substantially at the last bend made before that now being formed or at a bend made beforehand.

This pressure unit has the task of keeping in a level position in relation to the work platform the segment of bars bent but not constrained by the retaining and clamping means.

By the words "downstream of the bending unit" is meant the side of the bending unit opposite to that of the feed of the bars.

The supporting means of the pressure plate have a first inoperative position and a second working position and may be independent or be associated with the supporting means of a movable gripping unit carrying out controlled lengthwise displacement of the bundle of bars to be bent.

The movable gripping unit may have its supporting arm astride of the work platform or anchored to only one side of the work platform. The supporting means, if they are associated with the movable gripping unit, will move and be positioned therewith, but if they are independent, may be stationary in correspondence with the bending unit or be able to move along the axis of displacement of the bars.

The movable gripping unit performing controlled lengthwise displacement in the device according to the invention has three different positions.

To be more exact, the movable gripper performing controlled lengthwise displacement of the bundle of bars has a first clamping position, in which the bundle of vertically superimposed bars is clamped and kept in position between the jaws of the gripper, a second guiding position, in which the jaws are kept slightly apart to define a passage substantially about as wide as the diameter of the bars, and a third release position, in which the jaws are fully open and the gripper is raised from the work platform.

In the device according to the invention the means which retain and clamp the bundle of bars and are fitted immediately upstream and immediately downstream of the bending unit have a first clamping position, in which the jaws of the retaining and clamping means protrude onto the work platform and clamp the bundle of bars, a second guiding position, in which the jaws of the retaining and clamping means protrude from the work platform and are kept slightly apart to define a passage substantially about as wide as the diameter of the bars-,and a third retracted non-contact position, in which the retaining and clamping means are located below the work platform.

In the invention the guiding positions of the retaining and clamping means and of the movable gripper performing controlled lengthwise displacement have the purpose of preventing one or more bars of a bundle from becoming separated from the substantially vertical plane of positioning of the bundle of bars and from becoming entangled with the other bars, thus leading to the formation of incorrect and not level stirrups.

By means of the device according to the invention it is possible to produce identical level stirrups from a bundle of bars, since the bundle is always guided laterally during the operations of controlled lengthwise displacement and positioning and is thrust against the work platform during bending operations.

With the device according to the invention it is possible to achieve a method of production of bends which always provides the required results.

The method for production of bends according to the invention provides for automatic and systematic action during the bending step to prevent the already bent segment of a bundle of bars from being lifted from the work platform and/or to prevent the lateral shifting of one or more bars from the substantially vertical plane of positioning of the bundle.

In the method for production of bends according to the invention, after a bend has been made, the retaining and clamping means, which have been clamping the bundle of bars, are opened slightly to leave their first clamping position and to reach their second guiding position.

In this way the bundle of bars being displaced forwards is always guided laterally, thus preventing any shifting of one or more bars out of the vertical plane of positioning of the bundle from being able to cause the falling of the bundle.

Moreover, when the bundle of bars guided laterally as described above is fed forwards to its position for the next bend, the movable gripper of the unit performing controlled lengthwise displacement is opened slightly to be brought from its first clamping position to its second guiding position, thus enabling the superimposed bars forming the bundle to settle.

The pressure unit is then actuated and acts as an abutment element against the bundle of bars at the segment being bent or at an already bent segment of the bundle of bars downstream of the bending unit.

According to a variant the bending machine according to the invention includes television camera means installed at the bending unit and connected to a suitable video device so as to be able to check and possibly to correct the proper bending of the bundle of bars.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figures 1, 2, 4:
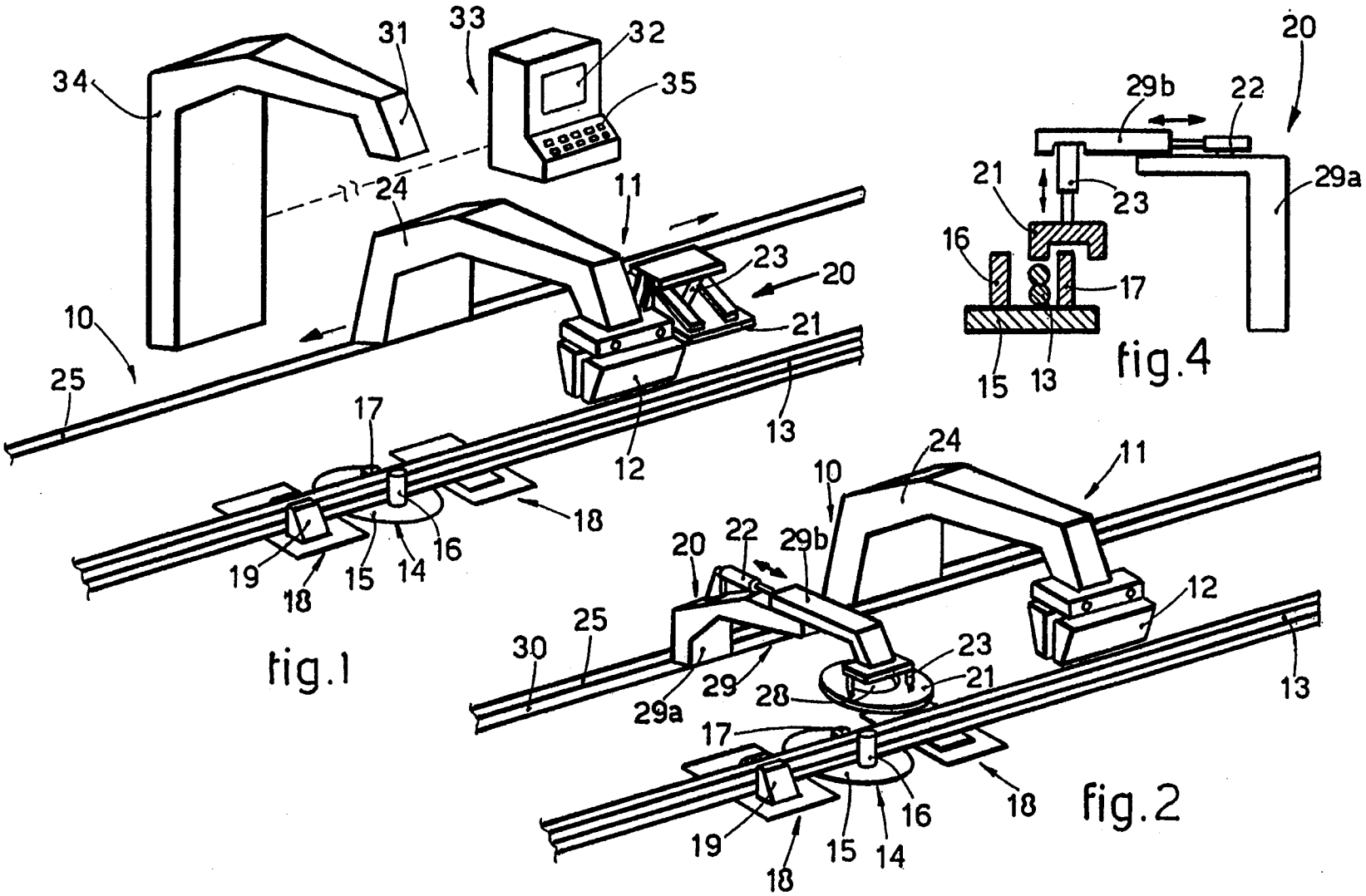
FIG. 1 is a three-dimensional diagram of the pressure unit fitted to a bending machine with a horizontal platform and, as in EP-A-0,502,341, with movable gripping means to perform controlled lengthwise displacement of bars, the gripping means being borne by a cantilever arm.
FIG. 2 is a diagram of a variant of the pressure unit of FIG. 1.
FIG. 4 shows a variant of the pressure unit of FIG. 3.

The number 10 in the attached figures denotes a generic bending machine with a horizontal work platform, as is shown in its essential components diagrammatically in the figures.

In particular, a unit for the controlled lengthwise displacement of a bundle 13 of bars is referenced with the number 11. In this case the unit 11 for such controlled lengthwise displacement consists of a movable gripper 12 borne on an arm 24, which is fitted as a cantilever and can slide along the length of an edge 25 of the machine 10.

The reference number 14 denotes an actual bending unit consisting of a movable disk 15, bending pin 16 and abutment roll 17.

So as to produce clockwise and anti-clockwise bends in all the four directions, the movable disk 15 can rotate about its own axis and can be displaced vertically so as to be retracted below the work platform.

Retaining and clamping means 18 are included upstream and downstream of the bending unit 14 and consists in this case of vertically retractable clamps 19.

The retaining and clamping means 18 fitted upstream and downstream are made to act on the bundle 13 of bars in alternative manners, that is to say, when bends in the leading end of the bars are to be made, the clamp 19 upstream of the bending unit 14 is actuated, whereas the downstream clamp 19 is actuated when bends in the trailing end of the bars are to be made, as is disclosed in EP-A-0.501.212.

In making shapes which entail segments of those shapes being superimposed on each other, lifting arms of the type disclosed in EP-A-0.502.341 may be included together with the bending unit 14.

The bending machine 10 according to the invention includes also a pressure unit 20 consisting in this case of a pressure plate 21, which is substantially flat and is borne by a supporting and positioning arm 29.

According to a first embodiment, the supporting and positioning arm 29 is independent of the lengthwise displacement unit 11 (FIG.2). In this embodiment the supporting and positioning arm 29 may be stationary in the zone of the bending unit 14 or may be able to move lengthwise along an appropriate guide rail 30.

The supporting and positioning arm 29, if it is stationary in the zone of the bending unit 14, will include advantageously a stationary element **29*a* and a movable element 29*b*, which is able to move, for instance, at a right angle to the direction of displacement of the bundle 13 of bars (FIG. 2**).

Thus, by actuation of an actuator 22 the pressure plate 21 can be withdrawn from contact with the unit 11 performing controlled lengthwise displacement of the bundle 13 of bars when that unit 11 is caused to slide along the work platform.

According to the embodiment shown in FIG. 1 the pressure plate 21 is coupled to the positioning and supporting arm 24 of the gripper 12 performing controlled lengthwise displacement of the bars and is displaced by that arm 24 along the length of the edge 25 of the machine 10.

The pressure plate 21 is lowered onto the bundle 13 of bars during the bending step so as to apply pressure on the bundle 13 of bars at the zone of the last bend made downstream of the bending unit 14 or at a previous bend. This has the purpose of preventing the lifting, from the work platform, of the already bent segment of the bundle 13 of bars not clamped by the retaining and clamping means 18.

Movement of the pressure plate 21 at a right angle to the work platform is carried out in this case by a jack 23. The jack 23 brings the pressure plate 21 from an inoperative position above the bundle 13 of bars to a working position in direct cooperation with the bars of the bundle 13.

The actuation pressure of the jack 23 can be adjusted to suit the diameter of the bars forming the bundle 13 being processed and the physical and structural properties of the bars. This pressure should not be too high so as not to generate an excessive tension on the bundle 13 of superimposed bars.

Figure 3:
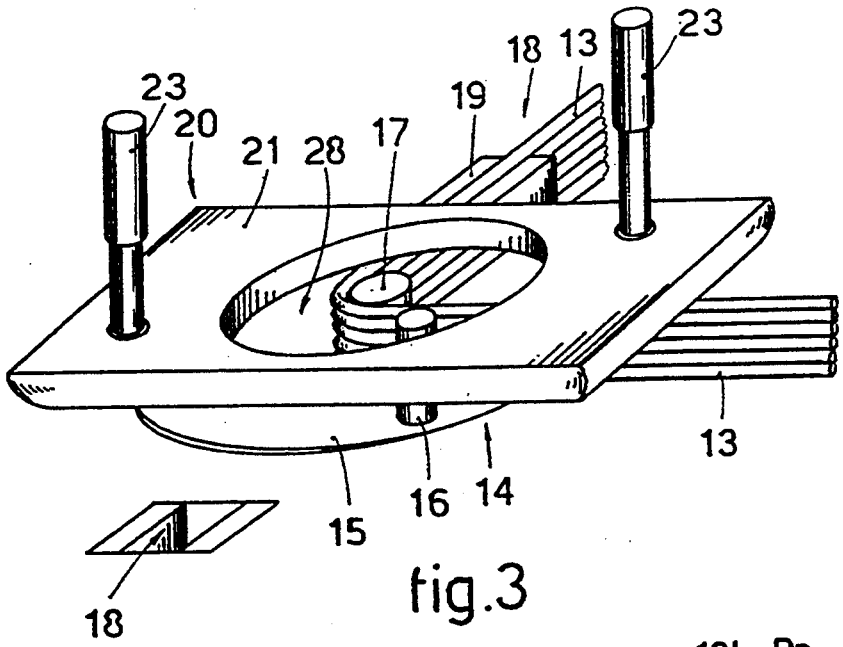
FIG. 3 shows in an enlarged scale the pressure unit cooperating with the bending unit according to the variant of FIG. 2.

FIGS. 2, 3 and 4 show embodiments in which the pressure plate 21 is caused to act at the zone of a bend being formed and during the bending step itself. This embodiment has the advantage that it can be used also with working sequences which provide consecutive bends all made by displacing the bundle 13 of the bars in one single direction.

In this case the pressure plate 21 is not brought into direct contact with the highest bar in the bundle 13 but is kept slightly separated therefrom, for instance by 2 or 3 mm. In this way excessive friction is not generated between the highest bar in that bundle 13 and the pressure plate 21 during the bending of that bundle 13 of bars.

The pressure plate 21 acts also as an element to retain the bundle 13 of bars by opposing any rising occurring of one or more bars of the bundle 13 from the work platform during the bending.

It is necessary in this case that the conformation of the pressure plate 21 should be such that the plate 21 will not contact the bending pin 16 and abutment roll 17 during the step of lowering the plate 21 onto the bundle 13 of bars.

The embodiment shown in FIGS. 2 and 3 includes, in this connection, a hole 28 which, when the pressure plate 21 is lowered onto the bundle 13 of bars, enables the bending pin 16 and abutment roll 17 to be moved and rotated without making contact.

This embodiment provides for the action of pressure on the bundle 13 of bars to be exerted externally in the vicinity of the bending pin 16 and abutment roll 17.

In the variant of FIG. 4 the conformation of the pressure plate 21 is such that the pressure on the bundle 13 of bars is exerted directly between the bending pin 16 and abutment roll 17. This zone is precisely the zone of formation of the bend and, as such, is most liable to any lifting of the bars forming the bundle 13 during the bending step.

In the bending machine 10 according to the invention the retaining and clamping means 18 have respectively a retracted non-contact position 18*a*, in which they are located below the work platform, a clamping position 18*b*, in which they clamp the bundle 13 of bars during the bending step, and a third guiding position 18*c*, in which they guide the sliding bundle 13 of bars laterally.

The guiding position 18*c* is taken up by the retaining and clamping means 18 whenever the bundle 13 of bars is gripped by the movable gripper 12 and is displaced forwards or backwards so as to be positioned correctly for a bend.

The distance between the jaws of the clamps 19 of the retaining and clamping means 18 in the guiding position 18*c* is greater than the diameter of the bars forming the bundle 13 of bars by a pre-set value, for instance between 3 and 5 mm., so as to lessen friction generated by the scraping of the bars of the bundle 13 against the clamps 19.

In this case the clamps 19 cooperate with suitable lateral guides 26 and are actuated by a double actuator 27.

This double actuator 27 consists of a first cylinder/-piston actuator 27*a*, which acts directly on the position of the jaws of the clamps 19, and a second cylinder/piston actuator 27*b*, which acts on the jacket of the first cylinder/piston actuator 27*a*. The embodiment shown in the figures is given as an example.

Figure 5A:
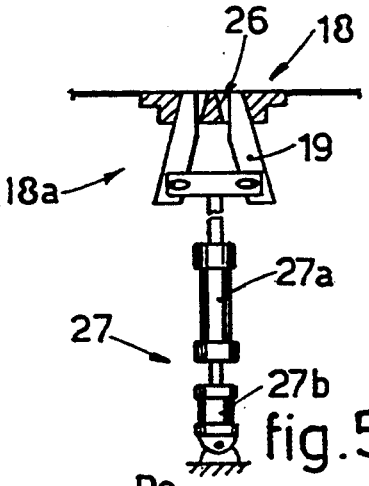
FIGS. 5A–5C show the retaining and clamping means in their three different positions of clamping, guiding and non-contact respectively.

The first cylinder/piston actuator 27*a* has the task of bringing the retaining and clamping means 18 from their retracted unclamped position 18*a* (FIG. 5*a*) to their clamping position 18*b* (FIG. 5*b*) and viceversa.

The second cylinder/piston actuator 27*b* has the task of bringing the retaining and clamping means 18 from their clamping position 18*b* (FIG. 5*b*) to their guiding position 18*c* (FIG. 5*c*), and viceversa.

Figure 5C:
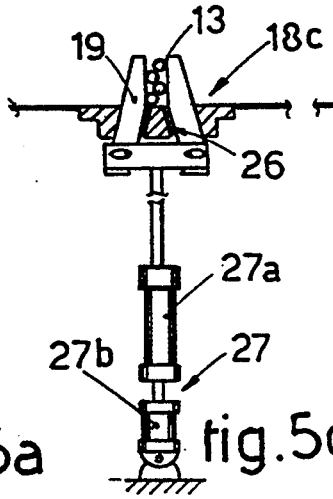
Figure 5B:
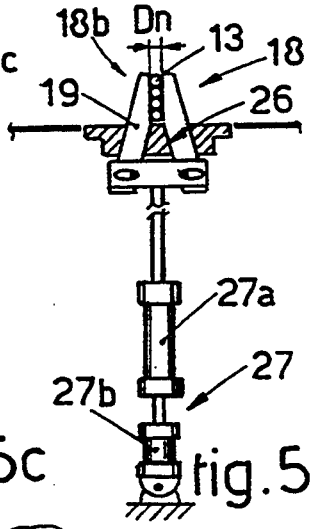
Figure 6B:
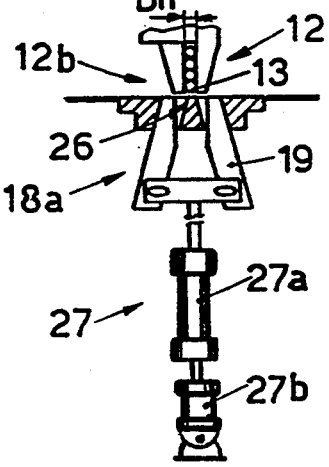
FIGS. 6A–6C show the controlled lengthwise displacement gripper in its three different positions of gripping, guiding and release respectively.
Figure 6C:
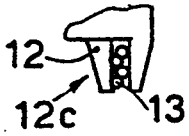
Figure 6A:
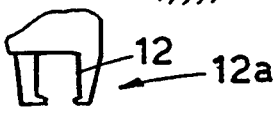

To be more exact, when the first cylinder/piston actuator 27*a* is upwardly actuated, the clamps 19 in cooperation with lateral guides 26 approach each other with a traversing movement until they clamp with a pre-set pressure the bundle 13 of bars, with the retaining and clamping means 18 in their clamping position 18*b* (FIG. 5*b*).

When the second cylinder/piston actuator 27*b* is downwardly actuated by a fixed travel, which may be a function of the diameter of the bars forming the bundle 13 of bars, the clamps 19 descend with a movement of mutual separation and free the bundle 13 of bars, thus bringing the retaining and clamping means 18 to their guiding position 18*c* (FIG. 5*c*).

When the second cylinder/piston actuator 27*b* is upwardly actuated, the bundle 13 of bars is again clamped in position.

Figure 7:
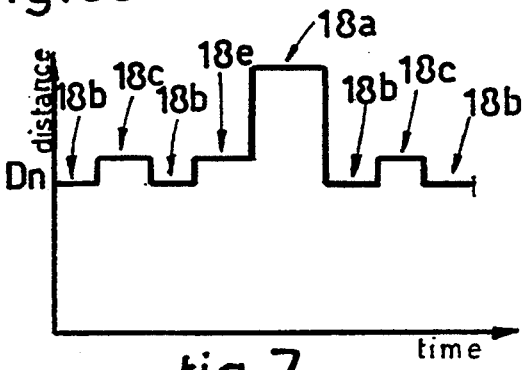
FIG. 7 is a diagram of a possible development in time of the distance between the jaws of the retaining and clamping clamp means acting on the bundle of bars.

FIG. 7 shows an example of a possible momentary development of the distance between the jaws of the clamps 19 of the retaining and clamping means 18 during the various steps of the bending cycle. The figure shows clearly the steps in which the retaining and clamping means 18 are in the various positions and, in particular, in the clamping position 18*b*, in which the distance between the jaws of the clamps 19 is equal to the nominal diameter "Dn" of the bars forming the bundle 13 of bars, in the guiding position 18*c*, in which that distance is equal to the diameter of the bars plus a pre-set constant value, and in their retracted position 18*a* of non-contact.

According to a variant the distance between the jaws of the clamps 19 in the guiding position 18*c* is equal to the diameter of the bars forming the bundle 13 of bars plus a pre-set value, which is a function of the nominal diameter "Dn" of the bars being processed.

In the bending machine 10 according to the invention the movable gripper 12 too which carries out the controlled lengthwise displacement of the bars has a first release position 12*a*, in which its jaws are fully opened and the gripper 12 is raised from the work platform, a second gripping position 12*b*, in which the bundle 13 of bars is gripped and held in position between the jaws of the movable gripper 12, and a third guiding position 12*c*, in which the jaws are kept slightly distanced from the bundle 13 of bars.

This third position 12*c* is taken up when the gripper 12 is opened to enable the bars forming the bundle 13 of bars to settle on top of each other before the pressure unit 20 acts on the bundle 13 of bars so as to ensure the level positioning of the bars.

The distance between the jaws of the movable gripper 12 in the guiding position 12*c* is greater than the diameter of the bars forming the bundle 13 of bars by a pre-set value, between 3 and 5 mm. for instance, so as to enable the bars to settle on one another before the pressure unit 20 applies pressure.

According to a variant the movable gripper 12 positions itself in the guiding position 12*c* also to lessen the friction generated by the rubbing of the bundle 13 of bars against the movable gripper 12 when the gripper 12 is made to slide along the stationary bundle 13 of bars on the work platform, as will be made clearer hereinafter.

The gripper 12 too is actuated by double actuators, which are not shown here but are of the type used to actuate the retaining and clamping means 18, as described above.

We shall now describe the momentary development of the various steps in a possible cycle of bending a bundle 13 of bars.

Figure 8:
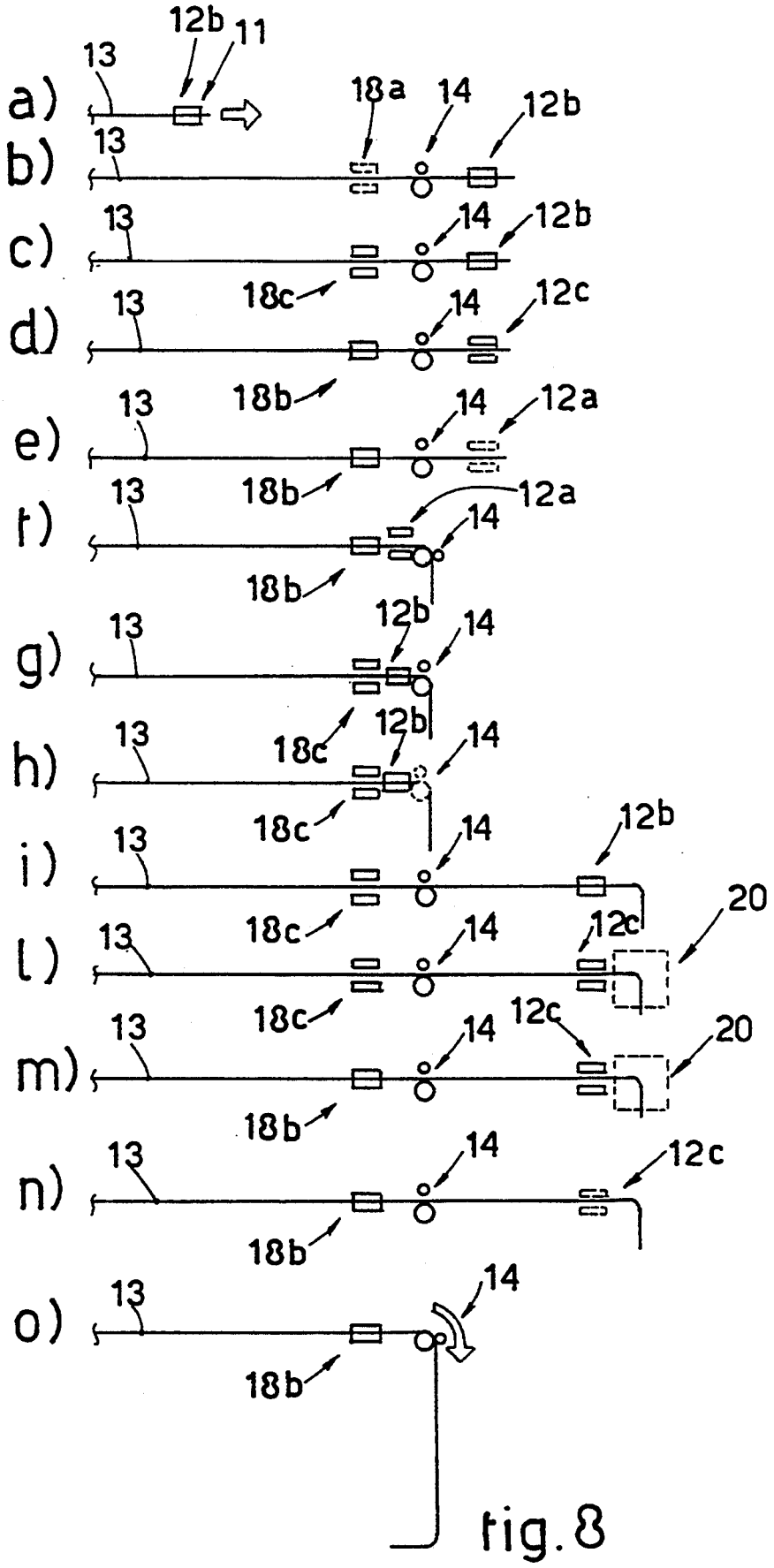
FIG. 8 shows a possible bending sequence according to the method of the invention.

FIGS. 8 show an example of a possible working sequence to produce bends according to the method of the invention.

In this case, when the movable gripper 12 is in the gripping position 12*b*, the controlled lengthwise displacement unit 11 engages the bundle 13 of bars (FIG. 8*a*) and feeds it downstream by the correct extent to pass the bending unit 14 (FIG. 8*b*).

The retaining and clamping means 18 located upstream of the bending unit 14 are brought from their retracted non-contact position 18*a* to their guiding position 18*c* (FIG. 8*c*).

The movable gripper 12 performing lengthwise displacement of the bars is taken from the gripping position 12*b* to its guiding position 12*c*, while the retaining and clamping means 18 are brought from their guiding position 18*c* to their clamping position 18*b* (FIG. 8*d*).

The movable gripper 12 is now moved to its release position 12*a* and is lifted from the work platform so as not to contact the bundle 13 of bars in the bending step (FIG. 8*e*).

The retaining and clamping means 18 located downstream do not take part in this step and are positioned in their retracted position 18*a* and are therefore not shown.

The bend is now made by rotation of the bending unit 14 by a determined angle, while the movable gripper 12 in its release position 12*a* is positioned upstream of the bending unit 14 and is lowered to cooperate with the work platform (FIG. 8*f*).

After performing the bending, the bending unit 14 is repositioned by an angle, while the retaining and clamping means 18 positioned upstream are moved from their clamping position 18*b* to their guiding position 18*c*, thus freeing but still supporting and guiding laterally the bundle 13 of bars.

The bundle 13 of bars is now gripped by moving the gripper 12 from its release position 12*a* to its gripping position 12*b* (FIG. 8*g*).

The bending unit 14 is now lowered so as to be retracted below the work platform so that it will not come into contact with the movable gripper 12 (FIG. 8*h*).

The unit 11 performing controlled lengthwise displacement of the bars and having its movable gripper 12 in the gripping position 12*b* displaces the bundle 13 of bars downstream by the correct distance to make the second bend (FIG. 8*i*).

During this displacement the bundle 13 of bars being moved is guided and supported laterally by the retaining and clamping means 18 located upstream in their guiding position 18*c*.

During this displacement the bending unit 14 is brought up again to its position of protruding from the work platform and is correctly positioned and oriented according to the type of bend, whether clockwise or anti-clockwise, to be made, and the axis connecting the bending pin 16 and abutment roll 17 constituting the bending unit 14 is substantially at a right angle to the axis of the bundle 13 of bars.

When the bundle 13 of bars has been brought to the correct position for the next bend, the movable gripper 12 is brought from its gripping position 12*b* to its guiding position 12*c* so as to hold the bundle 13 of bars laterally and to enable the bars to settle correctly on the work platform.

The pressure unit 20 is then actuated and acts by thrusting the bundle 13 of bars against the work platform and by opposing any lifting which may take place during the bending operation in the bars forming the bundle from the work platform (FIG. 8*l*).

Next, the retaining and clamping means 18 located upstream of the bending unit 14 are taken from their guiding position 18*c* to their clamping position 18*b* so as to keep in position the bundle 13 of bars to be bent (FIG. 8*m*).

The pressure unit 20 is now raised and the movable gripper 12 is brought to its release position 12*a* and is lifted from the work platform so as not to come into contact with the bundle 13 of bars in the bending step (FIG. 8*n*).

The bending unit 14 now makes the second bend in the bundle 13 of bars (FIG. 8*o*).

The above operations are repeated until the planned bending cycle has been completed.

According to a variant, during the steps of positioning the bundle 13 of bars and advantageously in the event of displacement of the bundle 13 of bars by a long segment the bending unit 14 can be positioned protruding above the work platform and be rotated by a required angle, so that it cooperates substantially with the bundle 13 of bars being thus fed and forms in this way a further supporting and guiding point for the bundle 13 of bars.

When bends are made in the trailing end of the bundle 13 of bars and the segment of the bundle 13 of bars upstream of the bending unit 14 is being bent, the retaining and clamping means 18 positioned upstream are always positioned in their retracted position 18*a*, whereas the retaining and clamping means 18 positioned downstream are actuated, as disclosed in EP-A-0.501.212 and EP-A-0.502.341.

In this case the retaining and clamping means 18 positioned downstream are brought from their clamping position 18*b* to their guiding position 18*c*, and vice-versa.

The method according to the invention enables stirrups to be made which have geometric shapes with excellent characteristics of levelness and which make the end product suitable for subsequent employment.

According to a variant, in order to restrict the number of movements of re-positioning of the movable gripper 12 of the means 11 performing controlled lengthwise displacement of the bars, or in order to limit the travel of the movable gripper 12 and therefore to lessen the times of the cycle of the bending machine 10, the movable gripper 12, when the first bend has been made, is brought to a position immediately upstream of the retaining and clamping means 18 located upstream of the bending unit 14.

At that point, seeing that the bundle 13 of bars is held clamped by the retaining and clamping means 18, it is certain that the bars forming the bundle 13 of bars are aligned and superimposed vertically in relation to each other.

Then the movable gripper 12 is lowered to cooperate with the work platform and is brought from its release position 12*a* to its guiding position 12*c*.

The means 11 performing controlled lengthwise displacement of the bars are now retracted upstream by the required length with the gripper 12 in its guiding position 12*c*, the gripper 12 sliding and constraining the bars of the stationary bundle 13 to be positioned vertically superimposed on each other.

The movable gripper 12, on arrival at the desired point, is brought to its gripping position 12*b*, thus enabling a lengthwise movement of displacement of the bars by a great extent to be carried out, or else enabling a plurality of successive movements of displacement of the bundle 13 of bars to be performed without requiring further re-positioning of the movable gripper 12 on the bundle 13 of bars.

According to yet another variant (see FIG. 1), the bending machine 10 according to the invention includes television camera means 31 positioned at a stationary position above and corresponding with the bending unit 14 and connected to a video means 32 connected in turn to a unit 33 which programs, actuates and controls the bending machine 10.

In this case the television camera means 31 are solidly fitted to, and supported by, a stationary arm 34.

A grid is included advantageously on the screen of the video means 32 and enables the bending angle to be quickly read so as to check the correctness of the bend made in real time.

In the event of a mistake or an incorrect bend it is possible to adjust the pre-set parameters by a keyboard 35, for instance, by means of the programming, processing and control unit 33 of the bending machine 10.

In this case, so as not to interfere with the television camera means 31, the movable gripper 12, after the bending operation, is positioned corresponding with the segment of the bundle 13 of bars between the bending unit 14 and the upstream retaining and clamping means 18 but is thus positioned only after the television filming has been carried out and after any necessary correction of the pre-set data has been performed.

We claim:

1. Method to carry out bends on a bending machine having a substantially horizontal work platform, the bending machine being suitable to process simultaneously a bundle of bars superimposed one on another in a plane substantially normal to the work platform and comprising a bending unit including an abutment roll and a bending pin, the bending unit being able to move laterally and to be temporarily retracted below the work platform so as to position the abutment roll in relation to the bundle of bars; first and second retaining and clamping units each having opposed jaws positioned as counterparts to each other in relation to the plane of positioning of the center line of the bundle of bars and being movable substantially vertically on lateral guides spaced about and inclined towards said center line, said jaws having a release position retracted below the work platform and working positions at least partly above the working platform, said first and second retaining and clamping units respectively being located immediately upstream and immediately downstream of the bending unit; and a unit including a gripper for the controlled lengthwise displacement of the bundle of bars positioned vertically one on another; the method comprising:

partly downwardly retracting the jaws from a clamping position to a guiding position during the steps of displacement of the bundle of bars by the gripper so as to provide a partial opening which enables the bundle of bars to slide and be guided;

bending the bundle of bars while thrusting the bundle of bars towards the work platform by an overlying pressure unit; and partly opening the gripper of the unit performing the controlled lengthwise displacement of the bars in at least one step of a bending cycle of the bending machine so as to keep the bundle of bars superimposed one on another in a substantially vertical position.

2. Method as in claim 1, whereby the gripper of the unit performing controlled lengthwise displacement of the bars is displaced along the bundle of bars and is opened partly during its step of displacement along the bundle of bars so as to keep the bundle of bars in a vertical position.

3. Method as in claim 1, whereby the gripper of the unit performing controlled lengthwise displacement of the bars is opened partly before and during the actuation of the pressure unit so as to keep the bundle of bars in a vertical position.

4. Method as in claim 1, whereby when the bundle of bars has been positioned for a new bend to be made, the gripper of the gripper of the unit performing controlled lengthwise displacement of the bars is opened slightly and the bundle of bars is pressed towards the work platform before one of the retaining and clamping units is clamped shut.

5. Method as in claim 1, whereby after at least one bend has been made, the gripper of the unit performing controlled lengthwise displacement of the bars is lowered from an Upper release position to its guiding position so as to cooperate with the bundle of bars immediately upstream of the first retaining and clamping unit positioned upstream of the bending unit and is retreated by a required length before being closed in its gripping position so as to grip the bundle of bars.

6. Method as in claim 1, whereby one of the retaining and clamping unit is positioned in its guiding position during downstream/upstream displacement of the bundle of bars.

7. Method as in claim 1, whereby the unit with a gripper performing the controlled lengthwise displacement of the bars is positioned in a guiding position during its positioning in relation to the bundle of bars.

8. Method as in claim 1, whereby before the actuation of the pressure unit, the unit with a gripper performing the controlled lengthwise displacement of the bars is positioned in a guiding position, and the bundle of bars after actuation of the pressure unit is clamped by one of the retaining and clamping in its clamping position.

9. Device having a substantially horizontal work platform to process simultaneously a bundle of bars superimposed one on another in a plane substantially normal to the work platform and comprising:

a bending unit including an abutment roll and a bending pin, the bending unit being able to move laterally and to be temporarily retracted below the work platform so as to position the abutment roll in relation to the bundle of bars;

a pressure unit comprising a pressure element cooperating at a required position along the substantially vertical lengthwise plane of the bundle of bars and having a first inoperative position and a second working position associated with the bundle of bars for preventing lifting of the bundle of bars from the work platform during bending of the bundle of bars;

first and second retaining and clamping units each having opposed jaws positioned as counterparts to each other in relation to the plane of positioning of the center line of the bundle of bars and being movable substantially vertically on lateral guides spaced about and inclined towards said center line, said jaws having a release position retracted below the work platform and working positions at least partly above the working platform, said first and second retaining and clamping units respectively being located immediately upstream and immediately downstream of the bending unit; and a unit including a gripper for the controlled lengthwise displacement of the bundle of bars positioned vertically one on another;

wherein the working positions of the jaws of the retaining and clamping units include a second clamping position clamping the bundle of bars and a third guiding position, in which a distance between the jaws is greater than a diameter of the bars such that the jaws guide the bundle of bars laterally during the lengthwise downstream/upstream displacement of the bundle by said gripper.

10. Device as in claim 9, in which the unit with a gripper performing controlled lengthwise displacement of the bars has a first release position raised from the work platform, a second gripping position and a third guiding position to guide the bundle of bars, said second gripping position and third guiding position being lowered from said first release position towards said working platform.

11. Device as in claim 9, in which the pressure element cooperates at a position over the bending unit.

12. Device as in claim 9, in which the pressure element can move along the bundle of bars, above that bundle and at least downstream of the bending unit.

13. Device as in claim 9, in which the pressure element is associated with the unit including a gripper performing controlled lengthwise displacement of the bars and can move vertically in relation to that unit.

14. Device as in claim 9, which comprises a television camera immovably installed above and corresponding with the bending unit the television camera means being connected to a video monitor so as to enable a machine operator to check the correctness of the bends made.

15. Device as in claim 14, further comprising an actuation and control unit operably connected to the bending machine and including a keyboard to allow an operator to adjust operation of the bending machine.

* * * * *